US005600340A

United States Patent [19]

Ho et al.

[11] Patent Number: 5,600,340

[45] Date of Patent: Feb. 4, 1997

[54] WIDEBAND OMNI-DIRECTIONAL ANTENNA

[75] Inventors: Thinh Q. Ho, Anaheim; John W. Rockway, San Diego, both of Calif.

[73] Assignee: The United States of America as represented by the Secretary of the Navy, Washington, D.C.

[21] Appl. No.: 422,366

[22] Filed: Apr. 13, 1995

[51] Int. Cl.[6] ..... H01Q 1/48

[52] U.S. Cl. ..... 343/846; 343/773

[58] Field of Search ..... 343/708, 773, 343/846, 774

[56] References Cited

U.S. PATENT DOCUMENTS

| | | | |
|---|---|---|---|
| 2,599,896 | 6/1952 | Clark et al. . | |
| 2,711,533 | 6/1955 | Litchford | 343/774 |
| 3,373,430 | 3/1968 | Croswell et al. . | |
| 3,656,166 | 4/1972 | Klupach et al. | 343/773 X |
| 3,795,914 | 3/1974 | Pickles | 343/774 X |
| 3,829,863 | 8/1974 | Lipsky . | |
| 3,942,180 | 3/1976 | Rannou et al. | 343/773 X |
| 4,143,377 | 3/1979 | Salvat et al. . | |
| 4,349,826 | 9/1982 | Lucanera . | |
| 4,851,859 | 7/1989 | Rappaport | 343/846 X |
| 4,940,990 | 7/1990 | Mostafa et al. . | |
| 5,140,334 | 8/1992 | Snyder et al. | 343/846 X |

OTHER PUBLICATIONS

Barrow et al., "Biconical Electromagnetic Horns", *Proceedings of the I.R.E.*, Dec. 1939, pp. 769–779.

Taguchi et al., "Analysis of Oblate Spheroidal Antenna", *IEEE Symposium*, 1993, pp. 968–971.

*Primary Examiner*—Donald T. Hajec

*Assistant Examiner*—Tho Phan

*Attorney, Agent, or Firm*—Harvey Fendelman; Peter A. Lipovsky; Michael A. Kagan

[57] ABSTRACT

An omni-directional antenna is provided which comprises: 1) a first prolate spheroid having an electrically conductive first outer surface and a first center axis, 2) a second prolate spheroid having an electrically conductive second outer surface and a second center axis, 3) a structural member for supporting the first prolate spheroid a fixed distance from the second prolate spheroid so that the first and second center axes are coincident, 4) a first resistive ring mounted to the surface of the first prolate spheroid; 5) a second resistive ring mounted to the surface of the second prolate spheroid; and 5) a coaxial cable having an outer conductor electrically connected to the second surface of the second prolate spheroid and a center conductor electrically connected to the first surface of the first prolate spheroid.

12 Claims, 4 Drawing Sheets

WIDEBAND OMNI-DIRECTIONAL ANTENNA

BACKGROUND OF THE INVENTION

The present invention generally relates to the field of antennas, and more particularly to an omni-directional antenna having a very wide bandwidth.

Ocean going ships have many different types of radio frequency (RF) communication needs, such as ship-to-ship communications, ship-to-air communications, and ship-to-land communications. Generally, a different frequency band is used for each type of RF communications application. Because antennas are essential elements of RF communication systems, there are practically just as many antennas as there are types of communications systems on board a ship because each antenna is designed for a specific frequency band.

Since the topside region of a ship is limited, it typically may be cluttered with many antennas, making expansion of a ship's RF communications capabilities difficult. Elimination of some or most of the antennas would be desirable in order to facilitate increased shipboard RF communication capabilities.

The most commonly used antenna configuration is the dipole antenna. Its popularity is due to its simplicity of design and its omnidirectional coverage. However, the dipole antenna has a limited bandwidth which is partly due to its impedance mismatch at wider bandwidths.

It may therefore be appreciated that a need exists for an omni-directional antenna having wide bandwidth characteristics.

SUMMARY OF THE INVENTION

The present invention provides an omni-directional antenna which comprises: 1) a first spheroid having an electrically conductive first outer surface and a first center axis; 2) a second spheroid having an electrically conductive second outer surface and a second center axis; 3) a structural member for supporting the first spheroid a fixed distance from the second spheroid so that the first and second center axes are coincident; 4) a first resistive ring mounted to the surface of the first spheroid; 5) a second resistive ring mounted to the surface of the second spheroid; and 5) a coaxial cable having an outer conductor DC coupled to the second surface of the second spheroid and a center conductor DC coupled to the first surface of the first spheroid.

In another embodiment of the invention, the omni-directional antenna, comprises: 1) a spheroid having an electrically conductive outer surface and a first center axis; 2) a ground plate having a perpendicular axis; a structural member for supporting the spheroid a fixed distance from the ground plate so that the first axis and the perpendicular axis are generally coincident; 3) a resistive ring mounted to the surface of the spheroid; and 4) a coaxial cable having an outer conductor DC coupled to the ground plate and a center conductor DC coupled to the electrically conductive surface of the spheroid.

DESCRIPTION OF THE PREFERRED EMBODIMENT

Figure 1:
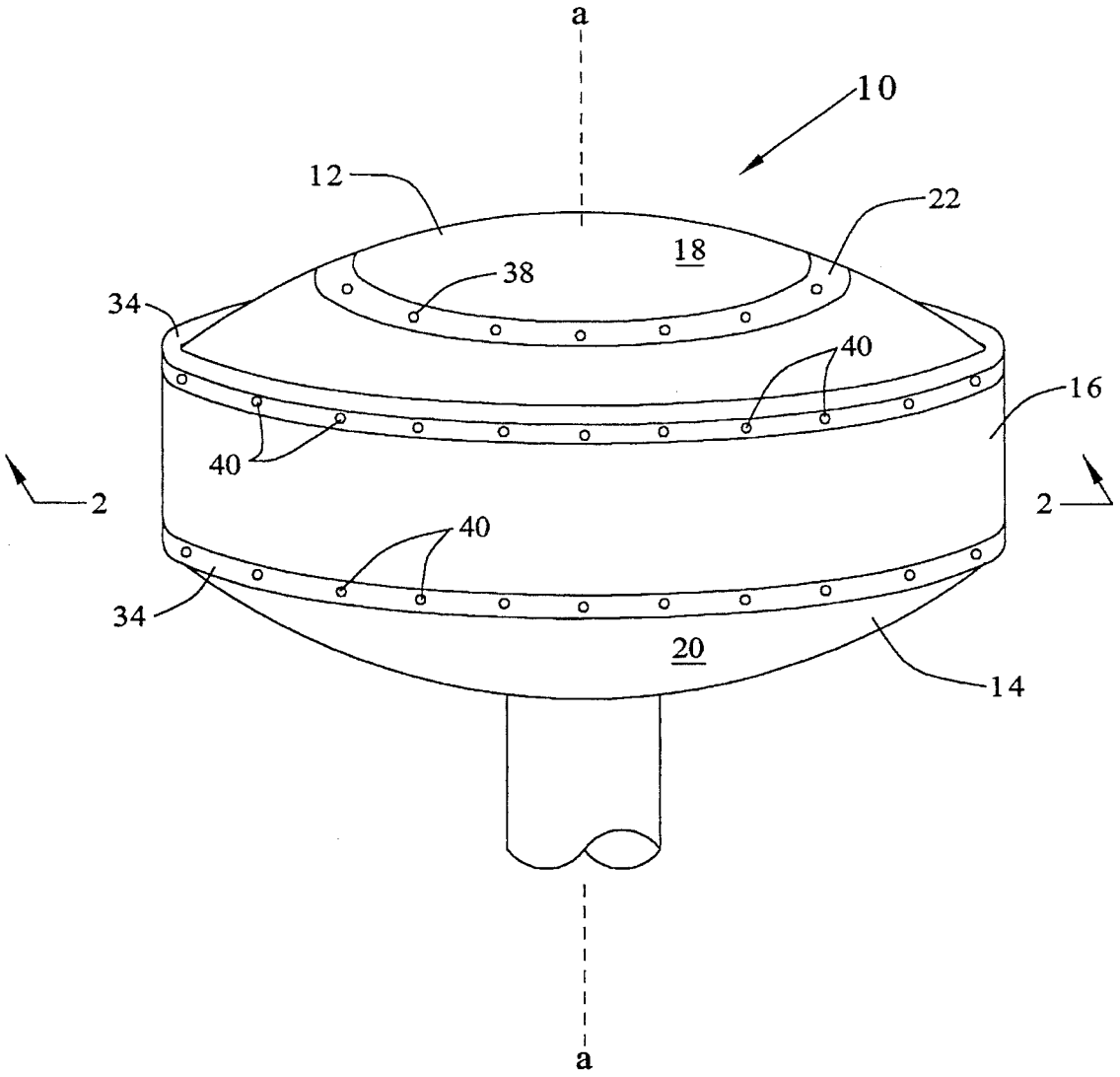
FIG. 1 is a perspective view of an omni-directional antenna embodying various features of the present invention.
Figure 2:
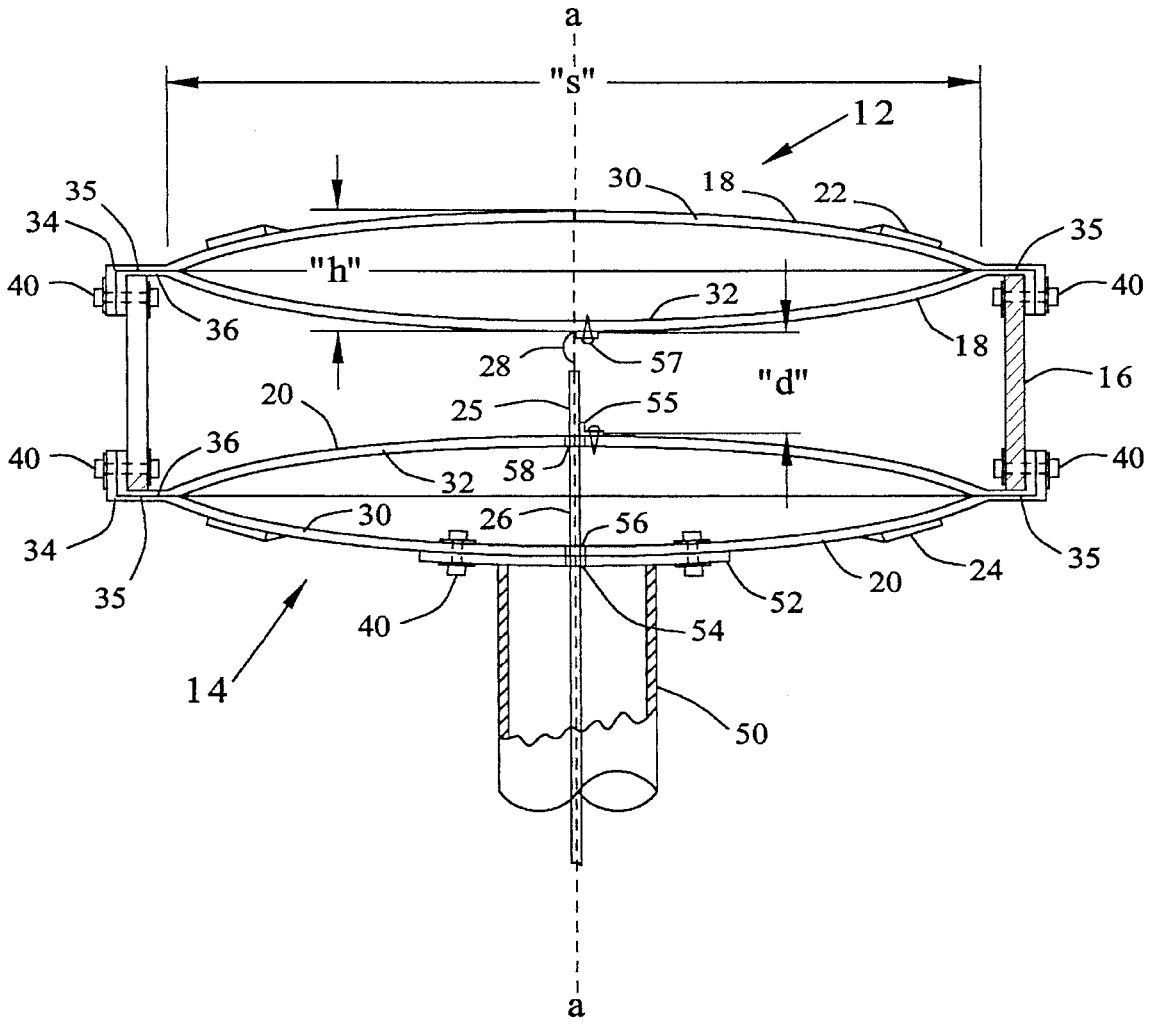
FIG. 2 is a cross-sectional view of the omni-directional antenna of FIG. 1 taken along line 2—2.

The present invention provides a very wideband omni-directional antenna. Referring to FIGS. 1 and 2, an omni-directional antenna 10 embodying various features of the present invention is shown to include two generally oblate spheroids 12 and 14, each having an electrically conductive surface 18 and 20, respectively. The spheroids 12 and 14 are mounted to a support structure 16 which may be a cylindrical shell. The surfaces 18 and 20 may be made of metal, metal foil, zinc paint, or of electrically conductive composite material. The contour surfaces 18 and 20 preferably have an exponentially or sinusoidal profile to enhance the impedance match of the antenna 10 over a broad bandwidth. Preferably, the major diameter, "s" of the spheroids 12 and 14 maybe approximately $2\lambda$, where $\lambda$ represents the longest wavelength of the radio frequency (RF) bandwidth which the antenna 10 is intended to detect, and the height, "h," of the spheroids 12 and 14 is preferably about $\lambda/4$. Resistive rings 22 and 24 are surface mounted to the outside surfaces 18 and 20 of spheroids 12 and 14, respectively, and are made of a lossy material such as a carbon based composite material. The resistive rings 22 and 24 function as an RF load to absorb any unradiated energy. The outer electrical conductor 25 (FIG. 2) of a TEM coaxial line 26 is DC coupled to the surface 20 of the spheroid 14 to provide the antenna 10 with a good ground. The inner electrical conductor 28 of the TEM coaxial line 26 is DC coupled to the contour surface 18 of the spheroid 12, and is electrically insulated from the outer electrical conductor 25. The supporting structure 16 is preferably made of an electrically nonconducting material, such as fiberglass or some other composite material, and also serves as a protective weather shield.

Referring to FIG. 2, the upper spheroid 12 may be constructed of two half-spheroid shells 30 and 32 made of fiberglass or some other composite material which is easy to fabricate into the appropriate shape. The thickness of the half-shells 30 and 32, by way of example, may be less than $0.1\lambda$. The perimeter of the top half-shell 30 may be defined by a hoop flange 34, and the perimeter of the bottom half-shell 32 may also be defined as a hoop flange 36. The half-shells 30 and 32 are fitted together so that the flange 36 closely and radially fits within flange 34. The flanges 34 and 36 provide stiffness to the spheroid 12 and facilitate assembly of the half-shells 30 and 32 into the spheroid 12. The spheroid 14 is similarly constructed of half-shells 30 and 32. The convex, or outer surfaces 18 and 20 of the half-shells 30 and 32, respectively, may be coated with metal foil or with zinc paint to make them electrically conductive. In another embodiment of the invention, the half-shells may be made of electrically conductive composite materials, thereby obviating the need for an electrically conductive outer surface layer, such as metal foil or zinc paint. The interfaces 35 between the half-shells 30 and 32 comprising each of the spheroids 12 and 14 should provide good electrical conductivity between the half-shells. Therefore, the abutting surfaces of the flanges 34 and 36 at their interfaces 35 are preferably coated with metal foil or zinc paint to provide a coating that is DC coupled to the outer surfaces 18 and 20 of the spheroids 12 and 14, respectively, if the base material comprising the half-shells 30 and 32 is not electrically conductive.

The resistive rings 22 and 24 may be affixed to spheroids 12 and 14, respectively, as for example, with fasteners 38, such as rivets, sheet metal screws, bolts, or other types of threaded fasteners, or by using a suitable adhesive.

The spheroids 12 and 14 are preferably attached to the support structure 16 using fasteners 40 mounted through the radially fitted flanges 34 and 36. The assembly of the support structure 16, and spheroids 12 and 14 positions the spheroids so that their minor axes are generally coaxially aligned along their common, minor axis a-a, and separated by a slight distance, "d," which preferably is much less than 0.1λ.

The antenna 10 may be mounted to an antenna support structure 50 on which a mounting plate 52 is attached. The half-shell 30 of spheroid 14 is attached to the plate 52 by fasteners 40.

The TEM coaxial line 26 feeds through the support structure 50 and through holes 54 in the plate 52 as well as through the spheroid 14 via holes 56 and 58 in the half-shells 30 and 32, respectively. The outer electrical conductor 25 of the TEM coaxial cable 26 is grounded to the exterior surface 20 of the outer half-shell 32 by the connector 55. The inner electrical conductor 28 is DC coupled to the electrically conductive surface 18 of the outer half-shell 32 of the other spheroid 12 by connector 57, and is electrically insulated from the outer electrical conductor 25.

Figure 3:
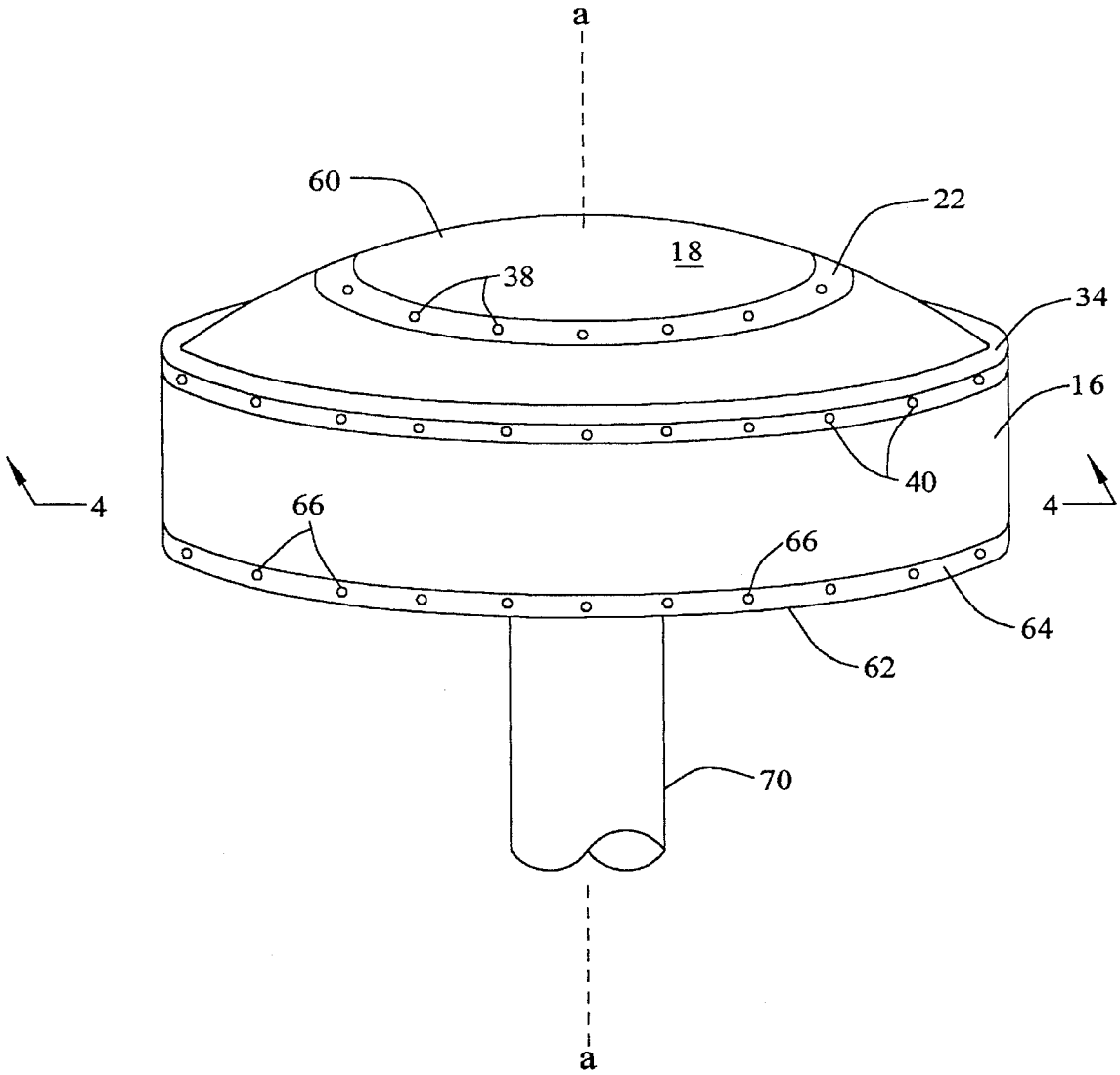
FIG. 3 is a perspective view of an omni-directional antenna which includes a ground plane and embodies various features of the present invention.
Figure 4:
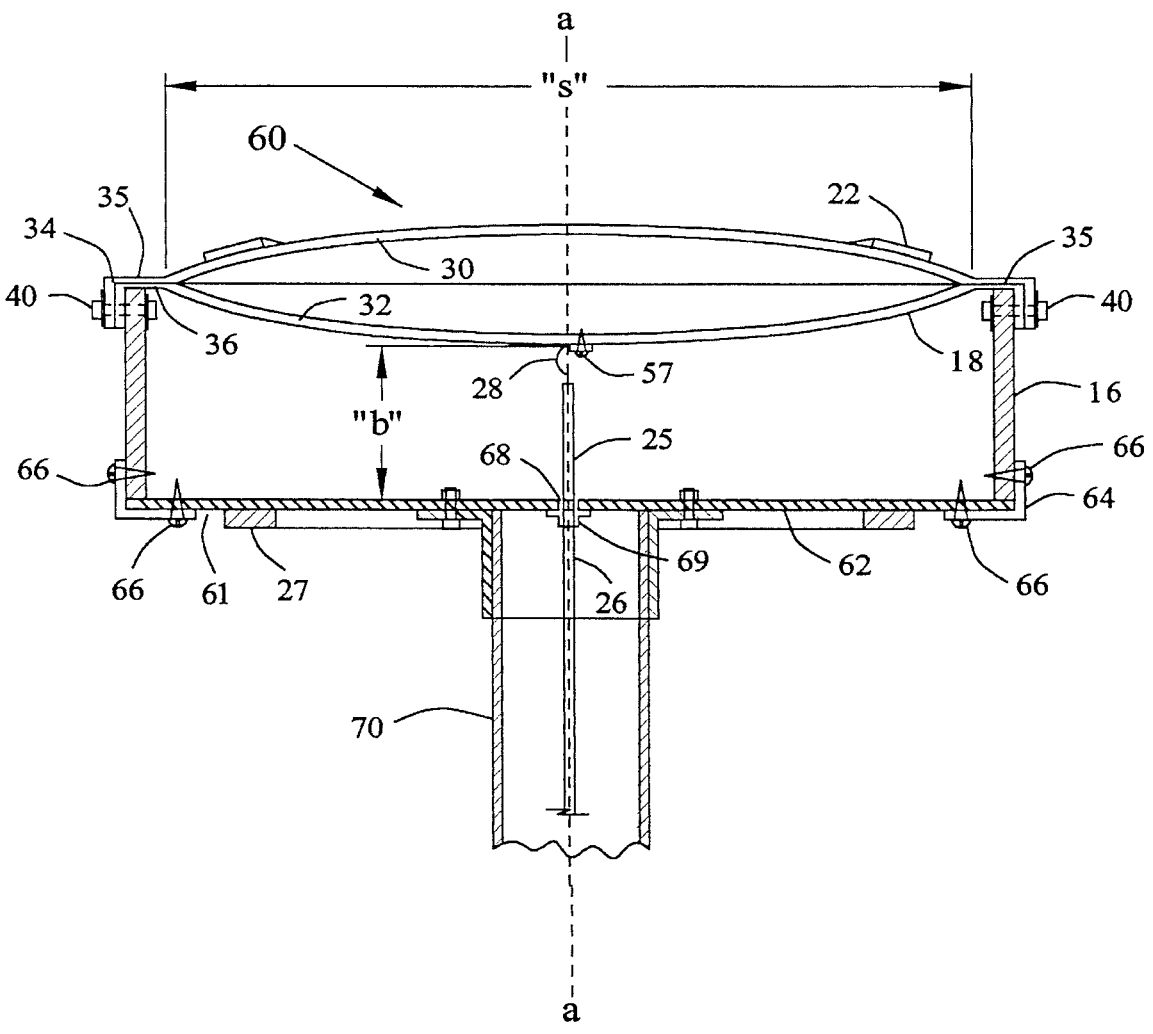
FIG. 4 is a cross-sectional view of the omni-directional antenna of FIG. 3 taken along view 4—4.

Another embodiment of the invention is described with reference to FIGS. 3 and 4. An omni-directional antenna 60 includes one generally oblate spheroid 12 which may be constructed as described above. However, rather than having a second spheroid 14 as does the antenna 10 shown in FIGS. 1 and 2, antenna 60 includes a ground plate 62, which by way of example, may be shaped as a right circular cylinder, or disc having a diameter preferably of about 2λ and a thickness, by way of example which may be about 0.15 cm. The ground plate 62 which may be attached to the support structure 16 by a flanged hoop 64 using fasteners 66 so that reference axis a—a extends perpendicular to the plane of the plate 62 and through its center, where the line a—a is also coincident with the minor axis of the spheroid 12. A resistive ring 27 made of a lossy material such as a carbon based composite material, as is well known by those skilled in the antenna design art, is concentrically affixed to the exterior surface 61 of ground plate 62, as for example by fasteners or adhesive, not shown. Fasteners 66 may be implemented as sheet metal screws, rivets, nuts and bolts, and the like. TEM coaxial line 26 extends via aperture 68 through the ground plate 62 to which it is grounded by conventional means, such as connector 69. The inner conductor 28 the TEM coaxial line 26 is DC coupled to the contour surface 18 of the spheroid 12 by connector 57.

The spheroid 12 is preferably attached to the support structure 16 using fasteners 40 mounted through the radially fitted hoop flange 34. The assembly of the support structure 16, spheroid 12 and ground plate 62 positions the spheroid and ground plate so that they are symmetrical about their common centroidal axis a—a, and are separated by a slight distance, "b," which is preferably much less than 0.1λ, but greater than zero.

The antenna 60 may be mounted to an antenna support structure 70 by conventional means.

Obviously, many modifications and variations of the present invention are possible in the light of the above teachings. It is therefore to be understood that within the scope of the appended claims the invention may be practiced otherwise than as specifically described.

We claim:

1. An omni-directional antenna, comprising:

a first spheroid having an electrically conductive first outer surface and a first center axis;

a second spheroid having an electrically conductive second outer surface and a second center axis;

a structural member for supporting said first spheroid a fixed distance from said second spheroid so that said first and second center axes are generally coincident;

first resistive ring mounted to said first outer surface;

a second resistive ring mounted to said second outer surface;

a first electrical conductor directly connected to said second spheroid; and a second electrical conductor directly connected to said first spheroid and electrically insulated from said first electrical conductor.

2. The omni-directional antenna of claim 1 wherein said first and second outer surfaces have an exponential profile.

3. The omni-directional antenna of claim 1 wherein said first and second outer surfaces have a cosine profile.

4. The omni-directional antenna of claim 1 wherein said first spheroid has an outside diameter approximately equal to 2λ, where λ represents a radio frequency wavelength.

5. The omni-directional antenna of claim 1 wherein said second spheroid has an outside diameter approximately equal to 2λ, where λ represents a radio frequency wavelength.

6. The omni-directional antenna of claim 1 in which said first and second spheroids are oblate spheroids.

7. An omni-directional antenna, comprising:

a spheroid having an electrically conductive outer surface and a first center axis; an electrically conductive ground plate having a perpendicular axis;

a structural member for supporting said spheroid a fixed distance from said ground plate so that said first axis and said perpendicular axis are generally coincident;

a resistive ring mounted to the outer surface of said spheroid;

a first electrical conductor directly connected to said surface of said spheroid; and a second electrical conductor directly connected to said ground plate and electrically insulated from said first electrical conductor.

8. The omni-directional antenna of claim 7 wherein said outer surface has an exponential taper.

9. The omni-directional antenna of claim 7 wherein said outer surface has a cosine taper.

10. The omni-directional antenna of claim 7 wherein said spheroid has an outside diameter approximately equal to 2λ, where λ represents a radio frequency wavelength.

11. The omni-directional antenna of claim 7 wherein said ground plate has an outside diameter approximately equal to 2λ, where λ represents a radio frequency wavelength.

12. The omni-directional antenna of claim 7 in which said spheroid is a oblate spheroid.

* * * * *